US010745883B2

(12) United States Patent
Gross et al.

(10) Patent No.: US 10,745,883 B2
(45) **Date of Patent: *Aug. 18, 2020**

(54) DIPPER DOOR TRIP ASSEMBLY

(71) Applicant: Harnischfeger Technologies, Inc., Wilmington, DE (US)

(72) Inventors: Matthew L. Gross, West Allis, WI (US); Richard L. Nicoson, Hartford, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 19 days.

This patent is subject to a terminal disclaimer.

(21) Appl. No.: 15/903,438

(22) Filed: Feb. 23, 2018

(65) Prior Publication Data

US 2018/0179728 A1 Jun. 28, 2018

Related U.S. Application Data

(63) Continuation of application No. 14/561,769, filed on Dec. 5, 2014, now Pat. No. 9,915,053.

(60) Provisional application No. 61/912,963, filed on Dec. 6, 2013.

(51) Int. Cl.

| | |
|---|---|
| ***E02F 3/40*** | (2006.01) |
| ***E02F 3/407*** | (2006.01) |
| ***E21C 27/30*** | (2006.01) |
| ***E02F 3/30*** | (2006.01) |
| ***E02F 3/46*** | (2006.01) |
| ***E21C 47/00*** | (2006.01) |

(52) U.S. Cl.

CPC ..... *E02F 3/4075* (2013.01); *E02F 3/304* (2013.01); *E02F 3/308* (2013.01); *E02F 3/46* (2013.01); *E21C 27/30* (2013.01); *E21C 47/00* (2013.01)

(58) Field of Classification Search

CPC ..... E02F 3/4075; E02F 3/304; E02F 3/46; E21C 47/00; E21C 27/30

USPC ..... 292/2, 23, 92

See application file for complete search history.

(56) References Cited

U.S. PATENT DOCUMENTS

| | | | |
|---|---|---|---|
| 1,338,219 | A | 4/1920 | Dutcher |
| 1,470,332 | A | 10/1923 | Schulte |
| 1,478,301 | A | 12/1923 | Shea |
| 1,574,763 | A | 3/1926 | Stevens |

(Continued)

FOREIGN PATENT DOCUMENTS

| | | |
|---|---|---|
| AU | 766563 | 10/2003 |
| AU | 2006202118 | 12/2006 |

(Continued)

OTHER PUBLICATIONS

Second Chinese Patent Office Action for Application No. 201410738796.0 dated Aug. 24, 2018 (27 pages including English Translation).

(Continued)

*Primary Examiner* — Ronald P Jarrett

(74) *Attorney, Agent, or Firm* — Michael Best & Friedrich LLP

(57) ABSTRACT

A dipper door trip assembly includes a dipper, a dipper door pivotally coupled to the dipper, a linkage assembly including a sliding latch bar disposed at least partially in the dipper door, and a latch keeper coupled to the dipper. The latch keeper includes a roller that engages and disengages the latch bar.

15 Claims, 5 Drawing Sheets

(56) References Cited

U.S. PATENT DOCUMENTS

| | | | | |
|---|---|---|---|---|
| 1,637,689 | A | 8/1927 | Endersby | |
| 1,653,620 | A | 12/1927 | Clark | |
| 1,660,598 | A | 2/1928 | Crane | |
| 1,709,466 | A | 4/1929 | Downie | |
| 1,712,040 | A | 5/1929 | Houghton | |
| 1,725,858 | A | 8/1929 | Esters et al. | |
| 1,905,191 | A | 4/1933 | Snow, Jr. | |
| 2,049,885 | A | 8/1936 | Younie | |
| 2,160,432 | A | 5/1939 | Davidson | |
| 2,238,414 | A | 4/1941 | Erickson | |
| 2,335,352 | A | 11/1943 | Murtaugh | |
| 2,374,108 | A | 4/1945 | Larsen | |
| 2,376,597 | A | 5/1945 | Jones | |
| 2,543,247 | A | 2/1951 | Larsen | |
| 2,544,682 | A | 3/1951 | Hilgeman | |
| 2,722,325 | A | 11/1955 | Dempster | |
| 3,369,324 | A * | 2/1968 | Tremblay | B02C 23/00 49/280 |
| 5,289,092 | A * | 2/1994 | Schmid | H02P 7/295 318/432 |
| 5,469,647 | A | 11/1995 | Profio | |
| 5,815,958 | A | 10/1998 | Olds et al. | |
| 5,815,960 | A | 10/1998 | Soczka | |
| 6,467,202 | B1 | 10/2002 | Brown, Jr. | |
| 7,096,610 | B1 | 8/2006 | Gilmore | |
| 8,136,272 | B2 | 3/2012 | Hren et al. | |
| 8,590,180 | B2 | 11/2013 | Hren et al. | |
| 9,890,515 | B2 | 2/2018 | Gross et al. | |
| 9,915,053 | B2 | 3/2018 | Gross et al. | |
| 2006/0208496 | A1 | 9/2006 | Kondratuk et al. | |
| 2011/0146114 | A1 * | 6/2011 | Hren | E02F 3/4075 37/445 |
| 2012/0192465 | A1 | 8/2012 | Opazo | |
| 2013/0192100 | A1 | 8/2013 | Gilmore et al. | |
| 2014/0007469 | A1 | 1/2014 | Gross et al. | |
| 2014/0059901 | A1 | 3/2014 | Nicoson et al. | |
| 2014/0225383 | A1 | 8/2014 | Simmonds et al. | |
| 2015/0159341 | A1 | 6/2015 | Gross et al. | |

FOREIGN PATENT DOCUMENTS

| | | |
|---|---|---|
| CL | 1838-2000 | 7/2001 |
| WO | WO2013116221 | 8/2013 |

OTHER PUBLICATIONS

Technical Report issued by Peru Patent Office for Application No. 1492.14 dated May 7, 2018 (13 pages including English translation).

Chilean Office Action for Application No. 2014-002577 dated Aug. 25, 2017 (11 pages with English Translation included).

* cited by examiner

DIPPER DOOR TRIP ASSEMBLY

CROSS-REFERENCE TO RELATED APPLICATIONS

This application is a continuation of U.S. application Ser. No. 14/561,769, filed Dec. 5, 2014, and claims priority to U.S. Provisional Application No. 61/912,963, filed Dec. 6, 2013, the entire contents of each of which are incorporated herein by reference.

BACKGROUND OF THE INVENTION

The present invention relates to the field of mining machines. Specifically, the present invention relates to a dipper door and a dipper door trip assembly on a mining machine, such as a rope shovel.

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. The handle is moved along a saddle block to maneuver a position of the dipper. During a hoist phase, the rope is reeled in by a winch in a base of the machine, lifting the dipper upward through the bank and liberating the material to be dug.

To release the material disposed within the dipper, a dipper door is pivotally coupled to the dipper. When not latched to the dipper, the dipper door pivots away from a bottom of the dipper, thereby freeing the material out through a bottom of the dipper. Current shovels use a dipper door trip mechanism to unlatch and release the dipper door from the dipper. The dipper door trip mechanism includes a latch bar that is moved in and out of an opening in a latch keeper on the dipper. Movement of the latch bar generates significant amounts of friction and wear on surfaces of the latch bar and latch keeper as the latch bar slides in and out of the latch keeper. Thus, current dipper door trip mechanisms employ use of expensive, exotic, high strength materials on the latch bar and/or latch keeper to try and withstand some of the high amounts of friction and wear.

SUMMARY

In accordance with one construction, a dipper door trip assembly includes a dipper, a dipper door pivotally coupled to the dipper, a linkage assembly including a sliding latch bar disposed at least partially in the dipper door, and a latch keeper coupled to the dipper. The latch keeper includes a roller that engages and disengages the latch bar.

In accordance with another construction, a dipper door trip assembly includes a dipper, a dipper door pivotally coupled to the dipper, a linkage assembly including a sliding latch bar disposed at least partially in the dipper door, a latch keeper coupled to the dipper that engages and disengages with the latch bar, and means for biasing the latch bar away from the latch keeper.

In accordance with another construction, a mining machine includes a boom, a handle coupled to the boom, a dipper coupled to the handle, a dipper door pivotally coupled to the dipper, and a dipper door trip assembly coupled to the dipper and the dipper door. The dipper door trip assembly includes a trip motor and a linkage assembly coupled to the trip motor, the linkage assembly including a sliding latch bar disposed at least partially in the dipper door. The linkage assembly further includes a pair of link members coupled to the latch bar. The dipper door trip assembly further includes a latch keeper coupled to the dipper, the latch keeper including a roller that engages and disengages the latch bar.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
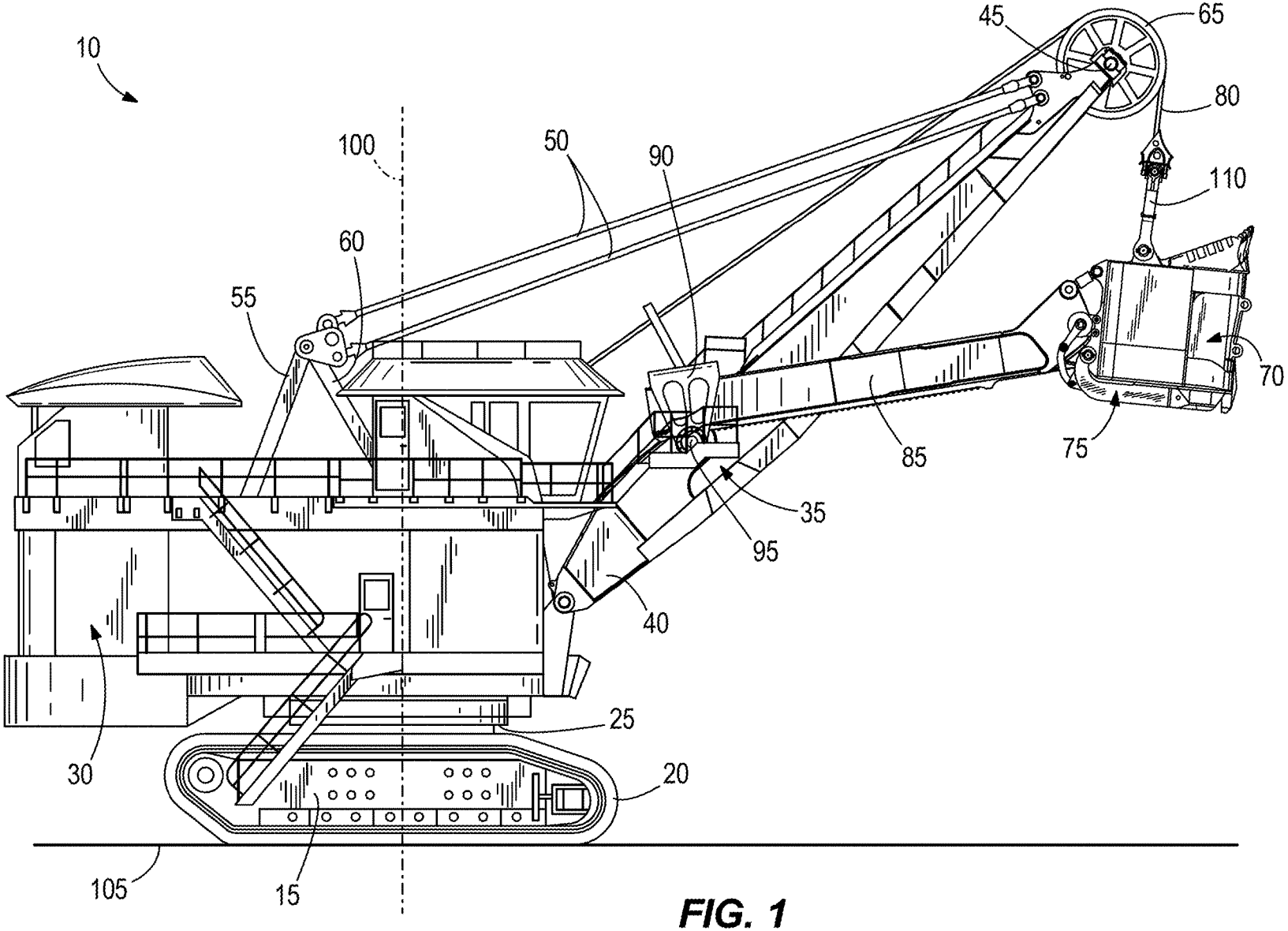
FIG. 1 is a perspective view of a mining shovel.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The turntable 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and attached to the dipper 70 at a bail 110. The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
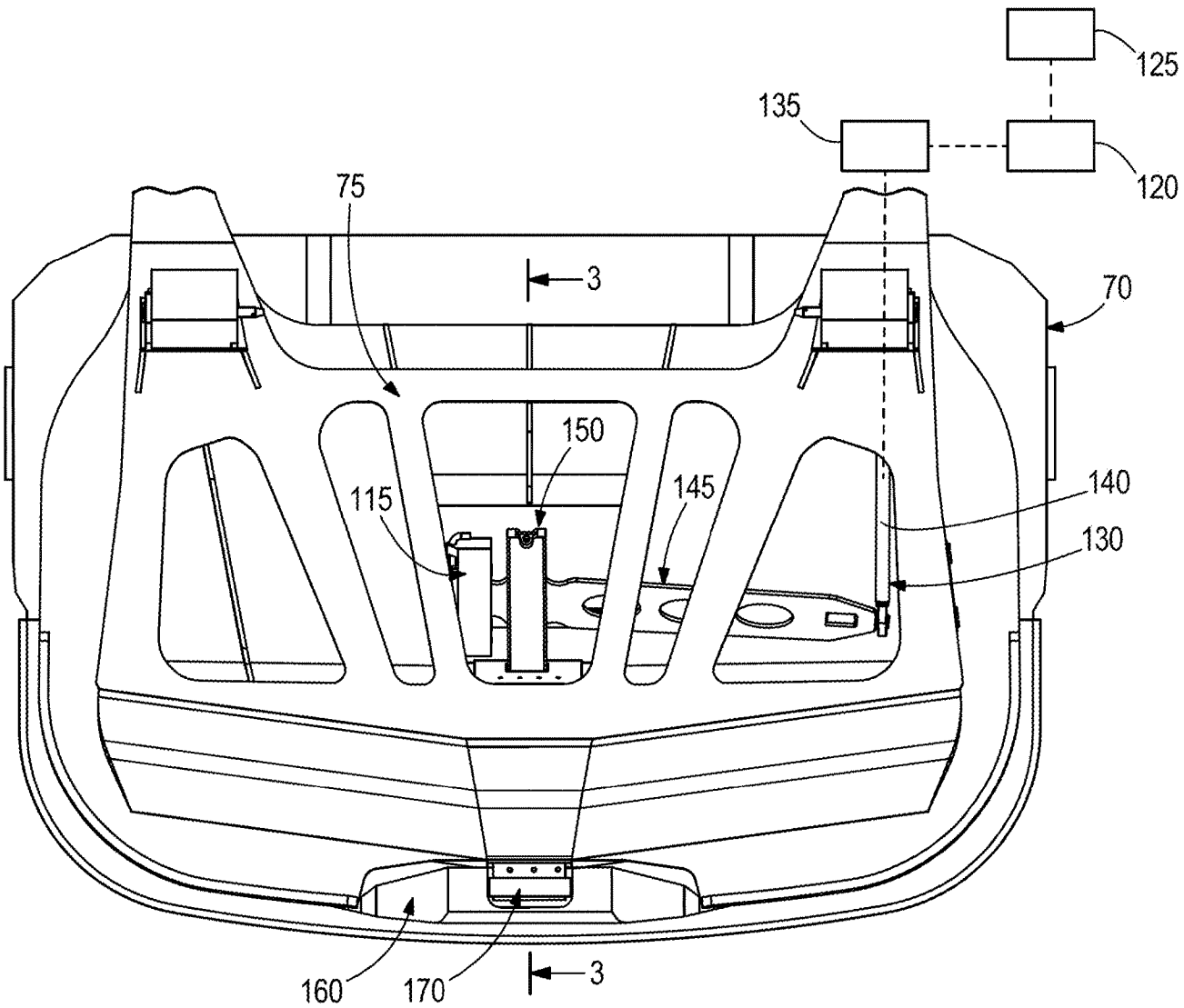
FIG. 2 is a bottom view of a dipper, a dipper door, and a dipper door trip assembly of the mining shovel of FIG. 1.
Figure 3:
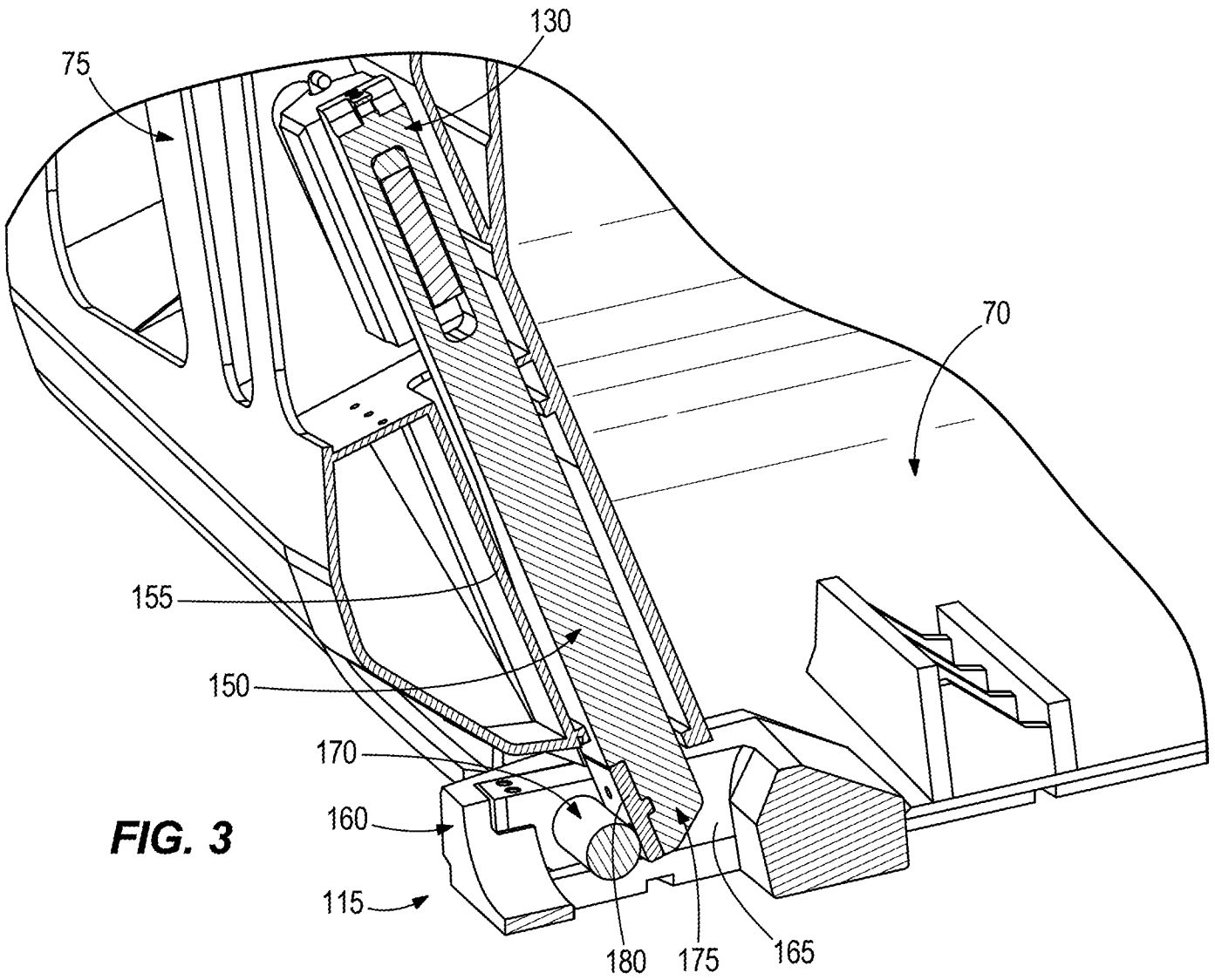
FIG. 3 is a cross-sectional view of the dipper door trip assembly, illustrating a latch bar and a latch keeper.
Figure 4:
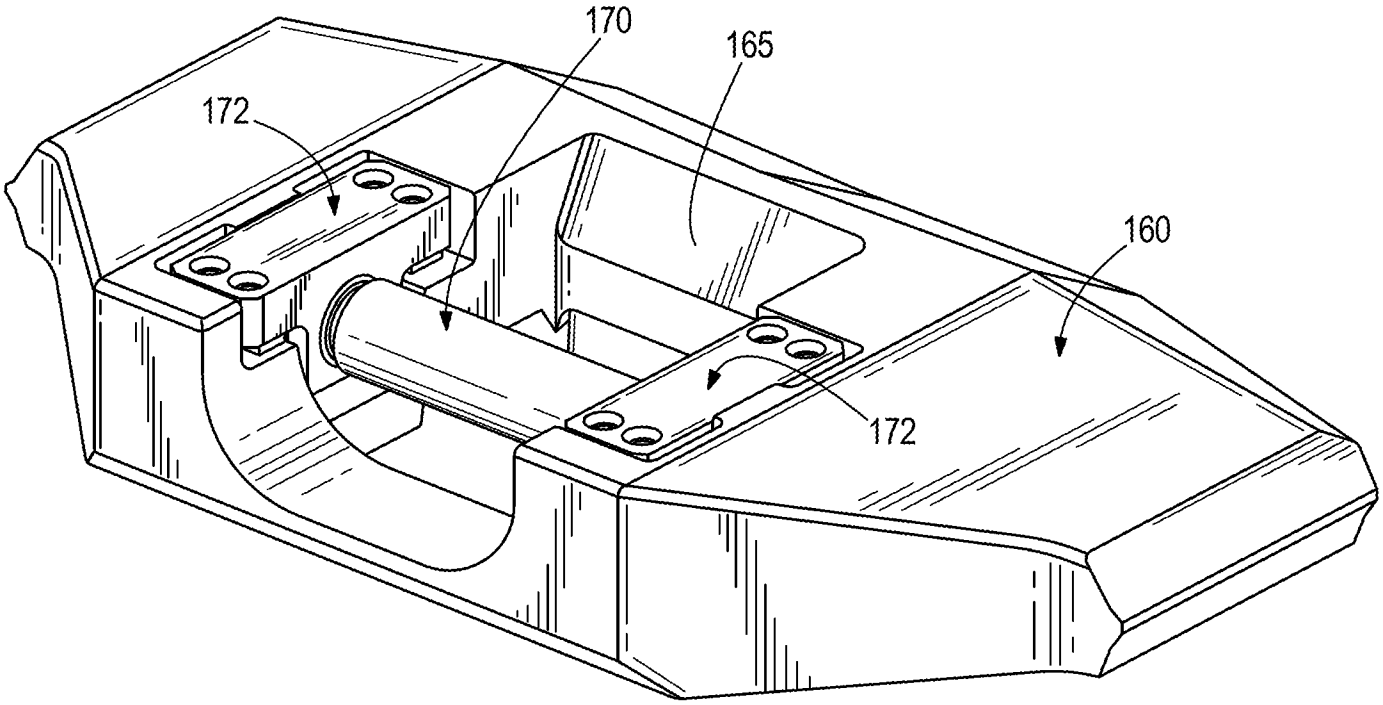
FIG. 4 is a perspective view of the latch keeper.

FIGS. 2-4 illustrate a dipper door trip assembly 115 for unlatching the dipper door 75 from the dipper 70. When activated, the dipper door trip assembly 115 allows the dipper door 75 to pivot away from the dipper 70 to release material (e.g., dirt) in the dipper 70. Although the dipper door trip assembly 115 is described in the context of the power shovel 10, the dipper door trip assembly 115 can be applied to, performed by, or used in conjunction with a variety of industrial machines (e.g., draglines, shovels, tractors, etc.).

With reference to FIG. 2, the dipper door trip assembly 115 includes a trip motor 120 (illustrated schematically) powered by an electrical power source 125 (also illustrated schematically) with its own motor controller. The trip motor 120 and the electrical power source 125 are located, for example, along the handle 85, the boom 35, the frame 30, or other locations on the shovel 10. In some constructions the trip motor 120 is driven in response to control signals sent from a remotely located controller on the shovel 10.

With reference to FIGS. 2 and 3, the dipper door trip assembly 115 includes a linkage assembly 130 coupled to the trip motor 120. The linkage assembly 130 is disposed at least partially within the dipper door 75, and includes an upper link arm 135 (illustrated schematically in FIG. 2) coupled to the trip motor 120 (e.g., with a rope, chain, etc.). While the upper link arm 135 is illustrated outside of the dipper door 75, in some constructions the upper link arm 135 is partially or entirely disposed within the dipper door 75. In some constructions the upper link arm 135 is pivotally coupled to the dipper door 75.

With continued reference to FIGS. 2 and 3, the linkage assembly 130 includes a connecting rod 140 coupled to the upper link arm 135, and a lever bar 145 (FIG. 2) coupled to the connecting rod 140. The lever bar 145 is coupled to a latch bar 150. Other constructions include different numbers and arrangements of linkage members other than the illustrated upper link arm 135, connecting rod 140, and lever bar 145.

When the trip motor 120 is activated, the upper link arm 135 is moved (e.g., pivoted by tension applied in an attached rope or chain), causing the connecting rod 140 to move within the dipper door 75. Movement of the connecting rod 140 causes the lever bar 145 to move, which causes the latch bar 150 to move (e.g., slide linearly within the dipper door 75).

As illustrated in FIG. 3, the latch bar 150 is disposed partially in a latch bar housing 155 that receives and guides the latch bar 150. The latch bar housing 155 is disposed within the dipper door 75. In some constructions the latch bar housing 155 includes guide bearings, rollers, plastic inserts, or other friction-reducing elements that facilitate movement of the latch bar 150 within the latch bar housing 155.

With reference to FIGS. 2-4, the machine 10 includes a latch keeper 160 that receives and guides the latch bar 150. The latch keeper 160 is coupled to the dipper 70, and includes an opening 165 for receiving the latch bar 150. The latch keeper 160 is a separate, removable, and replaceable element on the machine 10, although in some constructions the latch keeper 160 is integrally formed with the dipper 70.

With continued reference to FIGS. 2-4, the latch keeper 160 includes a roller 170. The roller 170 is disposed within the opening 165. The roller 170 engages and facilitates movement of the latch bar 150 through the opening 165. As illustrated in FIG. 4, the roller 170 is a metal pin that rotates on roller journals 172. In some constructions more than one roller 170 is used in the latch keeper 160.

With reference to FIG. 3, during a latched condition of the latch bar 150, an end 175 of the latch bar 150 is disposed within the latch keeper 160. The end 175 includes an insert 180 made of a low-friction material that is configured to engage the roller 170. Other constructions of the latch bar 150 do not include an insert 180.

Because the end 175 is disposed within the latch keeper 160, the dipper door 75 is locked relative to the dipper 70, and the dipper door 75 is unable to pivot away from the dipper 70. The weight of material (e.g., dirt, debris, etc.) in the dipper 70 presses down on the dipper 70 and the dipper door 75, forcing the end 175 against the roller 170 and inhibiting the end 175 of the latch bar 150 from moving out of the latch keeper 160.

With reference to FIGS. 2 and 3, and as described above, to move the latch bar 150 out of the latch keeper 160 and free the dipper door 75 from the dipper 70, the trip motor 120 is activated. Activation of the trip motor 120 causes movement of the lever bar 145, which pulls the latch bar 150 away from the latch keeper 160. As the latch bar 150 is moved away from the latch keeper 160, the end 175 of the latch bar 150 slides along the roller 170. The roller 170 facilitates a low-friction, sliding movement of the latch bar 150, making it easier to pull the latch bar 50 away from the latch keeper 160 than without the roller 170. Without the roller 170, the latch bar 150 would rub against and frictionally engage one or more inner surfaces in the latch keeper 160, generating significant amounts of friction and wear on both the latch bar 150 and the latch keeper 160, and requiring significant more activation force from the trip motor 120 to pull the latch bar 150 away from the latch keeper 160. Additionally, without the roller 170, mechanical stresses on the latch bar 150 would increase exponentially as the latch bar 150 is pulled out of the latch keeper 160, due to the constant weight of the material in the dipper 70 pressing down on the latch bar 150 and the decreasing area of frictional contact between the latch bar 150 and the surface of the latch keeper 160 upon which the latch bar 150 is rubbing across.

Use of the roller 170 eliminates significant amounts of friction and wear on the latch bar 150 and the latch keeper 160, and eliminates the exponential increase in mechanical stresses described above. The roller 170 provides a low friction rolling surface as the latch bar 150 is removed from the latch keeper 160. The roller 170 reduces friction and wear, and also alleviates or reduces the need for expensive and exotic, high-strength materials to be used in the latch bar 150 (e.g., in the insert 180) or the latch keeper 160.

Figure 5:
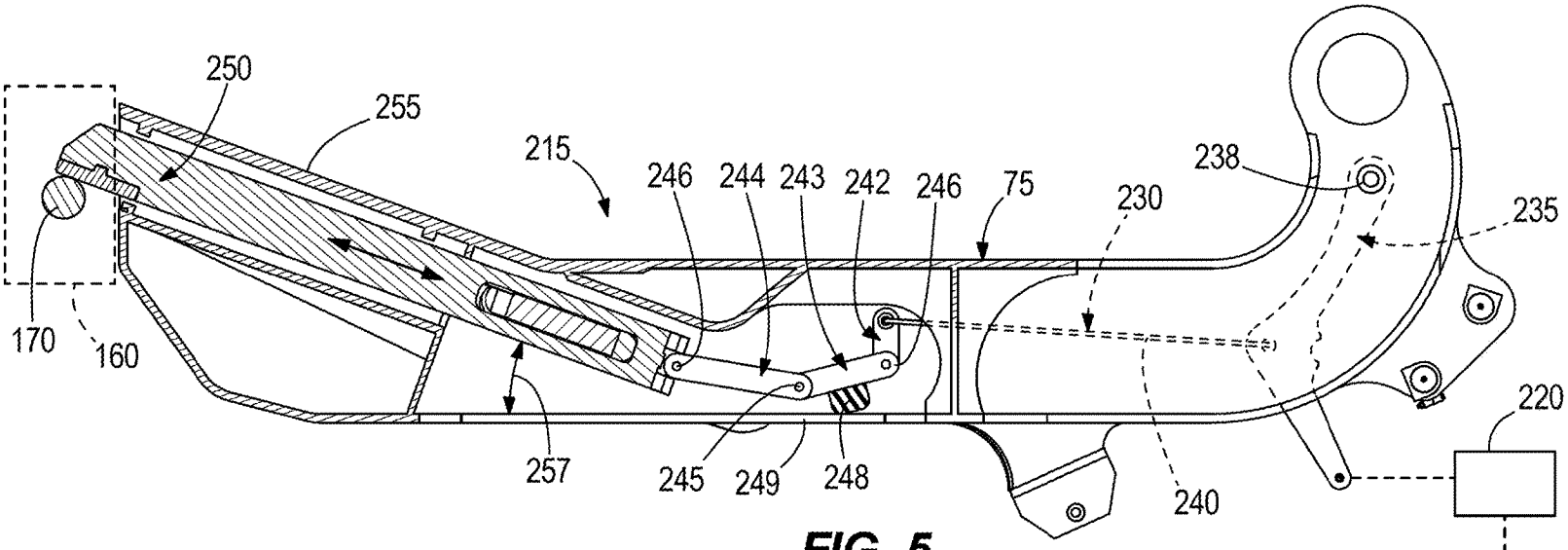
FIG. 5 is a schematic illustration of a dipper door trip assembly according to another construction, including a latch bar orientated at an angle within the dipper door.

FIG. 5 illustrates another dipper door trip assembly 215 for unlatching the dipper door 75 from the dipper 70. As with the dipper door trip assembly 115, the dipper door trip assembly 215 also includes a trip motor 220 (illustrated schematically in FIG. 5) powered by an electrical power source 225 (also illustrated schematically in FIG. 5) with its own motor controller. The trip motor 220 and the electrical power source 225 are located, for example, along the handle 85, the boom 35, the frame 30, or other locations on the shovel 10. In some constructions the trip motor 220 is driven in response to control signals sent from a remotely located controller on the shovel 10.

With reference to FIG. 5, the dipper door trip assembly 215 includes a linkage assembly 230 coupled to the trip motor 220. The linkage assembly 230 is disposed at least partially within the dipper door 70, and includes an upper link arm 235 coupled to the trip motor 220 (e.g., with a rope, chain, etc.). The upper link arm 235 is pivotally coupled to the dipper door 75 at a pivot point 238.

The linkage assembly 230 includes a connecting rod 240 coupled to the upper link arm 235, and link members 242, 243, 244 coupled to the connecting rod 240. At least two of the link members 242, 243, 244 are pivotally coupled to one another about a pivot point 245, such that opposing ends 246 of at least two of the link members 243, 244, are movable away from one another (e.g., to a position where the link members 243, 244 are straightened out and aligned along a linear direction) and movable toward one another (e.g., to a position as illustrated in FIG. 5, where the link members 243, 244 are angled toward one another, bringing the ends 246 closer together).

The link member 243 includes a stop member 248. The stop member 248 is a wedge or other similar structure that engages and contacts an inner wall 249 of the dipper door 75 in a first, latched position (e.g., as illustrated in FIG. 5), and disengages the inner wall 249 in a second, unlatched position.

With reference to FIG. 5, the link members 242, 243, 244 are coupled to a latch bar 250. The latch bar 250 is disposed partially within a latch bar housing 255 that receives and guides the latch bar 250 as the latch bar 250 moves. The latch bar housing 255 is disposed within the dipper door 75. In some constructions the latch bar housing 255 includes guide bearings, rollers, or other friction-reducing surfaces that facilitate movement of the latch bar 250 within the latch bar housing 255.

With continued reference to FIG. 5, the latch keeper 160 (illustrated schematically) receives and guides the latch bar 250. The roller 170 engages and facilitates movement of the latch bar 250 within the latch keeper 160, similar to the manner in which the roller 170 engages and facilitates movement of the latch bar 150.

As illustrated in FIG. 5, the latch bar 250 and the latch bar housing 255 are angled at an angle 257 relative to the inner wall 249, such that the latch bar 250 is biased toward a position away from the latch keeper 160 and the roller 170 (i.e., toward an unlatched position).

In the latched position (as illustrated in FIG. 5), the latch bar 250 is engaged with the roller 170 and is disposed within the latch keeper 160, such that the dipper door 75 is locked relative to the dipper 70. In the latched position, the link members 243, 244 are angled toward one another, such that the stopper member 248 engages the inner wall 249 of the dipper door 75, and provides a wedging force that helps to keep the link members 243, 244 locked in their angled position.

To release the wedge force, the trip motor 220 is activated. Activation of the trip motor 220 causes movement of the upper link arm 235, which causes movement of the connecting rod 240. Movement of the connecting rod 240 causes movement of the link members (e.g., pivoting of the link members 243, 244 relative to one another) to release the wedge member 248 from the inner wall 249, thereby allowing the latch bar 250 to slide down and away from the latch keeper 160. In some constructions one or more ends of the link members 242, 243, 244 are fixed within the dipper door 75. In some constructions the link members 242, 243, 244 all slide in a translational direction (e.g., away from the latch keeper 160 and to the right in FIG. 5) upon movement of the connecting rod 240, so as to release the wedge force and allow the latch bar 250 to slide down and away from the latch keeper 160. In some constructions one of the link members (e.g., link member 244) is pivotally coupled to the latch bar 250. Other constructions include different numbers and arrangements of link and stop members other than that illustrated.

As discussed above, the latch bar 250 is naturally biased away from the latch keeper 160 due to the orientation of the latch bar 250 within the dipper door 75. Thus, the activation force required to pull the latch bar 250 away from the latch keeper 160 is reduced as compared to a latch bar 250 that is not orientated and naturally biased away from the latch keeper 160.

While the illustrated construction in FIG. 5 utilizes link members 242, 243, 244 and a stop member 248 to help inhibit the biased, angled latch bar 250 from sliding away in the latched position, in other constructions different structures, such as pins, cams, plungers, etc. may be used to inhibit the biased, angled latch bar 250 from sliding away.

Figure 6:
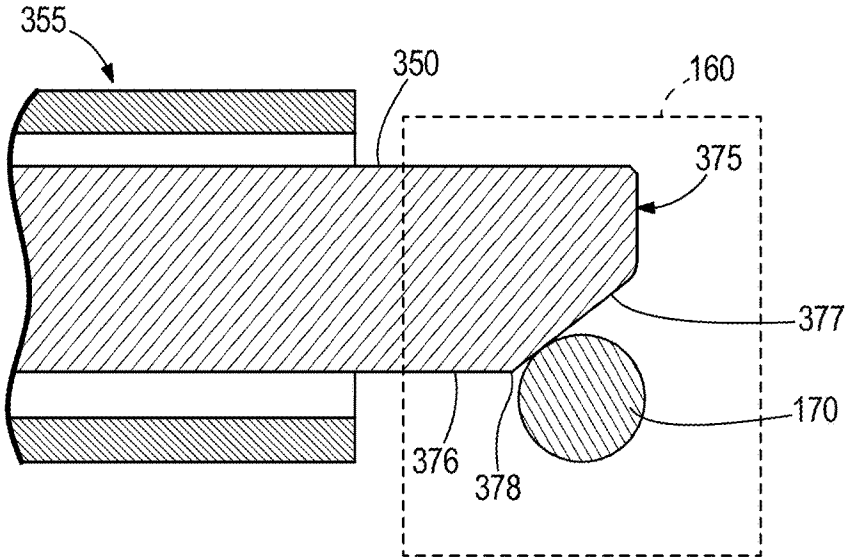
FIG. 6 is a schematic illustration of a latch bar according to another construction having a tapered surface.

FIG. 6 illustrates a latch bar 350 and a latch bar housing 355 for use in a dipper door trip assembly such as dipper door trip assemblies 115, 215. The latch bar 350 includes an end 375 that is disposed within the latch keeper 160 (illustrated schematically in FIG. 6). The end 375 includes a flat portion 376 and a tapered portion 377 adjacent the flat portion 376. The end 375 engages the roller 170 when the latch bar 350 is in a latched position (i.e., when the dipper door 75 is locked relative to the dipper 70). When the latch bar 350 has been pulled a certain distance out of the latch keeper 160 from the latched position, the end 375 becomes biased away from the latch keeper 160. For example, when the trip motor 120 (or other activation force) begins to pull the latch bar 350 away from the latch keeper 160, the roller 170 is initially in contact with the flat portion 376. The flat portion 276 slides along the roller 170, until the roller 170 reaches a transition point 378 (in the illustrated construction the intersection of the flat portion 376 and the tapered portion 377) on the latch bar 350. When the roller 170 reaches the transition point 378, the latch bar 350 shifts down within the latch bar housing 355 to permit the roller 170 to contact at least a portion of the tapered portion 377. The tapered portion 377, in conjunction with the roller 170, pushes and biases the latch bar 350 away from the latch keeper 160. The tapered portion 377 makes the activation force (e.g., from trip motor 120 or 220) less than that which would otherwise be needed to pull the latch bar 350 away from the latch keeper 160 if the latch bar 350 did not include the tapered portion 377.

In some constructions the latch bar 350 also includes a low-friction insert, such as the insert 180 described above.

The insert may be located on the tapered portion 377, on the flat portion 376, or on both of the tapered portion and flat portion 377, 376 to further help facilitate the sliding motion of the latch bar 355.

The illustrated constructions described above utilize a roller 170, an angled latch bar 250, and a tapered portion 377 to facilitate low-friction, low activation-force, and biased motion of a latch bar 150, 250, 350 away from the latch keeper 160. In other constructions a roller or other structure may additionally be used within the latch bar housings 155, 255, 355, or within other areas of the dipper door trip assemblies 115, 215 described above, to further reduce friction and wear within the dipper door trip assemblies 115, 215.

Although the invention has been described in detail with reference to certain preferred embodiments, variations and modifications exist within the scope and spirit of one or more independent aspects of the invention as described.

What is claimed is:

1. A dipper door trip assembly comprising:

a dipper;

a dipper door pivotally coupled to the dipper;

a linkage assembly including an elongate, sliding latch bar disposed at least partially in the dipper door, wherein the sliding latch bar is configured to slide linearly relative to the dipper door;

a latch keeper coupled to the dipper; and a roller configured to facilitate sliding of the latch bar as the latch bar slides linearly with respect to the dipper door;

wherein a portion the latch bar is configured to be disposed within the latch keeper during a latched condition of the latch bar, wherein the latch bar includes an outer surface, wherein an insert is coupled to the outer surface, and wherein the insert is configured to engage the roller.

2. The dipper door trip assembly of claim 1, wherein the roller is a separate, replaceable component of the dipper door trip assembly.

3. The dipper door trip assembly of claim 1, wherein the roller is a metal pin that rotates on roller journals in the latch keeper.

4. The dipper door trip assembly of claim 1, further comprising a trip motor coupled to the linkage assembly.

5. The dipper door trip assembly of claim 4, wherein the linkage assembly includes an upper link arm coupled to the trip motor, the upper link arm pivotally coupled to the dipper door at a pivot point.

6. The dipper door trip assembly of claim 5, wherein the linkage assembly further includes a connecting rod coupled to the upper link arm.

7. The dipper door trip assembly of claim 1, further comprising a latch bar housing disposed within the dipper door, wherein the latch bar housing is sized and shaped such that the latch bar is configured to slide linearly within the latch bar housing, wherein the latch bar housing includes an opening through which a portion of the latch bar is configured to extend linearly, wherein the portion of the latch bar is configured to engage the roller.

8. The dipper door trip assembly of claim 1, wherein the latch bar includes an end having a flat portion and a tapered portion directly adjacent the flat portion, and wherein the roller is configured to sequentially engage both the flat portion and the tapered portion during linear sliding movement of the latch bar.

9. The dipper door trip assembly of claim 1, wherein the latch bar includes an end configured to be disposed within the latch keeper in a latched position, wherein the end includes a flat portion and a tapered portion adjacent the flat portion, wherein the end is configured to engage the roller when the latch bar is in the latched position, wherein the latch bar and the roller are arranged such that when the latch bar has been pulled linearly a predetermined distance out of the latch keeper from the latched position, the roller moves out of contact with the flat portion and into contact with the tapered portion, and wherein the tapered portion, in combination with the roller, is configured to push and bias the latch bar away from the latch keeper.

10. The dipper door trip assembly of claim 9, wherein the insert is coupled to the flat portion.

11. A mining machine comprising:

a boom;

a handle coupled to the boom;

a dipper coupled to the handle;

a dipper door pivotally coupled to the dipper; and a dipper door trip assembly coupled to the dipper and the dipper door, the dipper door trip assembly including a trip motor and a linkage assembly coupled to the trip motor, the linkage assembly including an elongate, sliding latch bar disposed at least partially in the dipper door and configured to slide linearly relative to the dipper door, the dipper door trip assembly further including a latch keeper coupled to the dipper, and a roller that is configured to facilitate sliding of the latch bar as the latch bar slides linearly with respect to the dipper door;

wherein the latch bar includes an end configured to be disposed within the latch keeper in a latched position, wherein the end includes a flat portion and a tapered portion adjacent the flat portion, wherein the end is configured to engage the roller when the latch bar is in the latched position, wherein the latch bar and the roller are arranged such that when the latch bar has been pulled linearly a predetermined distance out of the latch keeper from the latched position, the roller moves out of contact with the flat portion and into contact with the tapered portion, and wherein the tapered portion, in combination with the roller, is configured to push and bias the latch bar away from the latch keeper, and wherein the latch bar includes an insert coupled to the flat portion.

12. The mining machine of claim 11, wherein the roller is a metal pin that rotates on roller journals in the latch keeper, and wherein the latch bar includes a first end disposed within the latch keeper during a latched condition of the latch bar.

13. The mining machine of claim 11, wherein the linkage assembly includes an upper link arm coupled to the trip motor, the upper link arm pivotally coupled to the dipper door at a pivot point, and wherein linkage assembly further includes a connecting rod coupled to the upper link arm at least one link member coupled to both the connecting rod and to the latch bar.

14. The mining machine of claim 11, further comprising a latch bar housing disposed within the dipper door, wherein the latch bar housing is sized and shaped such that the latch bar is configured to slide linearly within the latch bar housing, wherein the latch bar housing includes an opening through which a portion of the latch bar is configured to extend linearly, wherein the portion of the latch bar is configured to engage the roller.

15. A dipper door trip assembly comprising:

a dipper;

a dipper door pivotally coupled to the dipper;

a linkage assembly including an elongate, sliding latch bar disposed at least partially in the dipper door, wherein the sliding latch bar is configured to slide linearly relative to the dipper door;

a latch keeper coupled to the dipper; and a roller configured to facilitate sliding of the latch bar as the latch bar slides linearly with respect to the dipper door;

wherein the latch bar includes an end configured to be disposed within the latch keeper in a latched position, wherein the end includes a flat portion and a tapered portion adjacent the flat portion, wherein the end is configured to engage the roller when the latch bar is in the latched position, wherein the latch bar and the roller are arranged such that when the latch bar has been pulled linearly a predetermined distance out of the latch keeper from the latched position, the roller moves out of contact with the flat portion and into contact with the tapered portion, and wherein the tapered portion, in combination with the roller, is configured to push and bias the latch bar away from the latch keeper, and wherein the latch bar includes an insert coupled to the flat portion.

* * * * *